US006104307A

United States Patent [19]

Hanratty

[11] Patent Number: 6,104,307

[45] Date of Patent: Aug. 15, 2000

[54] PACKAGE-MOUNTED SENSOR

[76] Inventor: Peter Hanratty, 128 Delwood Close, Castleknock, Dublin 15, Ireland

[21] Appl. No.: 09/156,125

[22] Filed: Sep. 17, 1998

[51] Int. Cl.[7] ..... G08B 21/00

[52] U.S. Cl. ..... 340/689; 340/571

[58] Field of Search ..... 340/689, 571, 340/569

[56] References Cited

U.S. PATENT DOCUMENTS

| | | | |
|---|---|---|---|
| 4,190,828 | 2/1980 | Wolf | 340/571 |
| 4,274,077 | 6/1981 | Feiger | 340/571 |
| 4,985,695 | 1/1991 | Wilkinson et al. | 340/571 |
| 5,260,689 | 11/1993 | Meyers et al. | 340/571 |
| 5,434,559 | 7/1995 | Smiley et al. | 340/689 |
| 5,721,535 | 2/1998 | Ikefuji | 340/571 |

*Primary Examiner*—Jeffery A. Hofsass
*Assistant Examiner*—John Tweel, Jr.

[57] ABSTRACT

A condition responsive alarm system is provided including a mount with an adhesive situated on a rear face thereof. Also included is a portable power source secured to the mount. An indicator is secured to the mount for alerting a user upon the receipt of power. Connected between the power source and the indicator is a condition responsive trigger for supplying power to the indicator upon the presence of a condition.

8 Claims, 2 Drawing Sheets

PACKAGE-MOUNTED SENSOR

BACKGROUND OF THE INVENTION

1. Field of the Invention

The present invention relates to indicator alarms and more particularly pertains to a new package-mounted sensor for alerting a user of a condition in which a package is being subjected.

2. Description of the Prior Art

The use of indicator alarms is known in the prior art. More specifically, indicator alarms heretofore devised and utilized are known to consist basically of familiar, expected and obvious structural configurations, notwithstanding the myriad of designs encompassed by the crowded prior art which have been developed for the fulfillment of countless objectives and requirements.

Known prior art indicator alarms include U.S. Pat. No. 4,697,174; U.S. Pat. No. 4,792,796; U.S. Patent Des. 282, 243; U.S. Pat. No. 4,057,029; U.S. Pat. No. 3,336,530; and U.S. Pat. No. 2,794,084 which are all incorporated herein by reference.

In these respects, the package-mounted sensor according to the present invention substantially departs from the conventional concepts and designs of the prior art, and in so doing provides an apparatus primarily developed for the purpose of alerting a user of a condition in which a package is being subjected.

SUMMARY OF THE INVENTION

In view of the foregoing disadvantages inherent in the known types of indicator alarms now present in the prior art, the present invention provides a new package-mounted sensor construction wherein the same can be utilized for alerting a user of a condition in which a package is being subjected.

The general purpose of the present invention, which will be described subsequently in greater detail, is to provide a new package-mounted sensor apparatus and method which has many of the advantages of the indicator alarms mentioned heretofore and many novel features that result in a new package-mounted sensor which is not anticipated, rendered obvious, suggested, or even implied by any of the prior art indicator alarms, either alone or in any combination thereof.

To attain this, the present invention generally comprises a plurality of planar rectangular mounts each constructed from a flexible material such as paper or cardboard. An adhesive is situated on a rear face of the mount with a waxed paper backing situated over the adhesive. The waxed paper is adapted for being removed from the adhesive such that the mount may be secured to a package. Note FIG. 2. Each of the mounts has a portable power source and an alarm for transmitting an audible signal upon the receipt of power. A first one of the mounts includes a cross-shaped housing coupled to a front face of the mount. A conductive ball bearing is freely situated within the housing. As shown in FIG. 3A, a pair of spaced conductors pass through ends of three of four portions of the cross-shaped housing. Each of the conductors are connected to either the power source or alarm. As such, upon the ball bearing being situated within one of the three of the four portions, power is supplied from the power source to the alarm, thereby indicating that the package is tilted. A second one of said mounts includes a thermistor and a photoelectric cell each connected in parallel with respect to each other. The thermistor and photoelectric cell are further connected in series between the power source and alarm for supplying power from the power source to the alarm. This only occurs upon either the detection of light or heat. As such, an indication is given that the package is subjected to light and heat. A third and fourth of the mounts include a transmitter connected to the power source. In use, the transmitter is adapted for transmitting a signal via free space for a predetermined distance. A receiver is connected between the power source and alarm. The receiver is adapted for supplying power from the power source to the alarm upon the receipt of the signal via free space. This indicates that a package is with the predetermined distance from another package. Finally, a fifth mount includes a timepiece connected to the power source. In use, the shelf life expiration date of the package is set on a digital display screen, as shown in FIG. 7. The current date is displayed on a countdown display screen, as shown in FIG. 7. When the countdown date reaches the set shelf life expiration date, the alarm is activated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new package-mounted sensor apparatus and method which has many of the advantages of the indicator alarms mentioned heretofore and many novel features that result in a new package-mounted sensor which is not anticipated, rendered obvious, suggested, or even implied by any of the prior art indicator alarms, either alone or in any combination thereof.

It is another object of the present invention to provide a new package-mounted sensor which may be easily and efficiently manufactured and marketed.

It is a further object of the present invention to provide a new package-mounted sensor which is of a durable and reliable construction.

An even further object of the present invention is to provide a new package-mounted sensor which is susceptible of a low cost of manufacture with regard to both materials and labor, and which accordingly is then susceptible of low prices of sale to the consuming public, thereby making such package-mounted sensor economically available to the buying public.

Still yet another object of the present invention is to provide a new package-mounted sensor which provides in the apparatuses and methods of the prior art some of the advantages thereof, while simultaneously overcoming some of the disadvantages normally associated therewith.

Still another object of the present invention is to provide a new package-mounted sensor for alerting a user of a condition in which a package is being subjected.

Even still another object of the present invention is to provide a new package-mounted sensor that includes a mount with an adhesive situated on a rear face thereof. Also included is a portable power source secured to the mount. An indicator is secured to the mount for alerting a user upon the receipt of power. Connected between the power source and the indicator is a condition responsive trigger for supplying power to the indicator upon the presence of a condition.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
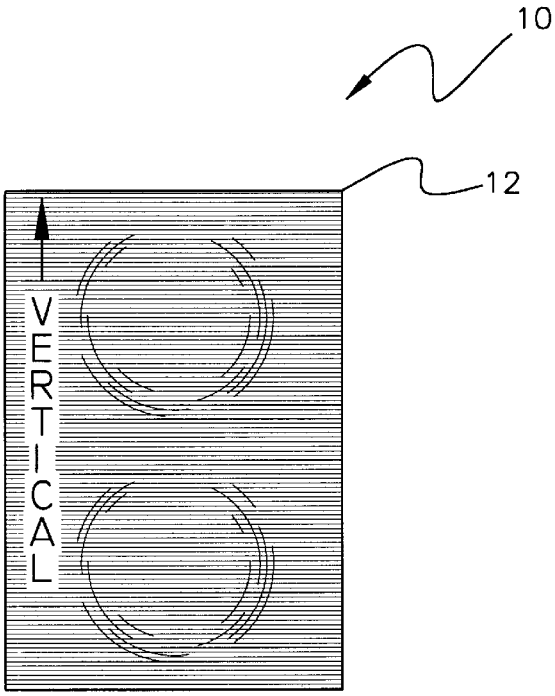
FIG. 1 is a front view of a new package-mounted sensor according to the present invention.
Figure 2:
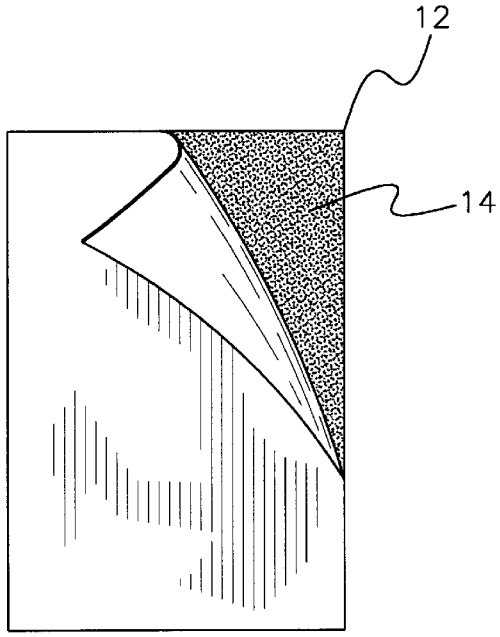
FIG. 2 is a rear view of the present invention showing the adhesive thereof.

With reference now to the drawings, and in particular to FIGS. 1 through 7 thereof, a new package-mounted sensor embodying the principles and concepts of the present invention and generally designated by the reference numeral 10 will be described.

The present invention, designated as numeral 10, includes a plurality of planar rectangular mounts 12 each constructed from a flexible material such as paper, plastic, cardboard or the like. The mounts each preferably have a height of 3 inches, a width of 2 inches, and a thickness of about ⅛ of an inch. An adhesive 14 is situated on a rear face of the mount with a waxed paper backing situated over the adhesive. The waxed paper is adapted for being removed from the adhesive such that the mount may be secured to a package. Note FIG. 2. It should be noted that the package of the present invention refers to any container, cargo, case, drum, carton or the like. Each of the mounts has a portable power source 16 and a piezoelectric alarm 18, or buzzer, for transmitting an audible signal upon the receipt of power. The battery preferably takes the form of a silver oxide battery while the alarm is similar to those employed in the art of greeting cards. In the alternative, a visible indicator such as a LED or the like may be employed in lieu of or in combination with the buzzer.

Figure 3B:
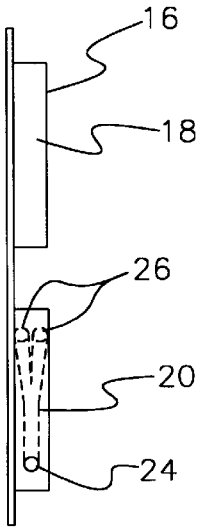
FIG. 3B is a side view of the component of the present invention that monitors tilting of a package.
Figure 3A:
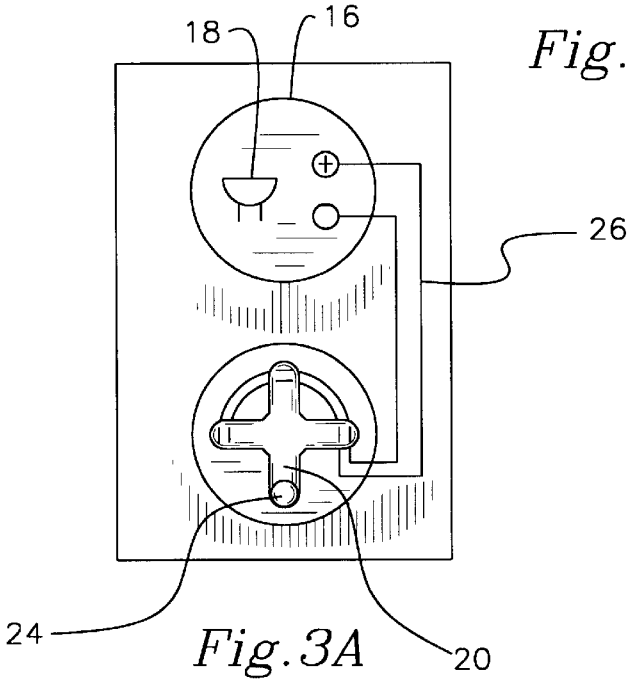
FIG. 3A is a front view of a component of the present invention that monitors tilting of a package.
Figure 4:
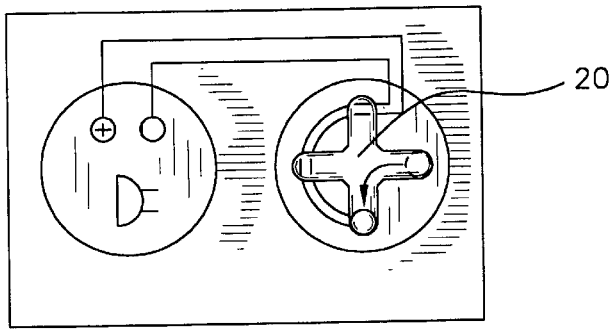
FIG. 4 is another front view of the component of FIG. 3A in use.
Figure 5:
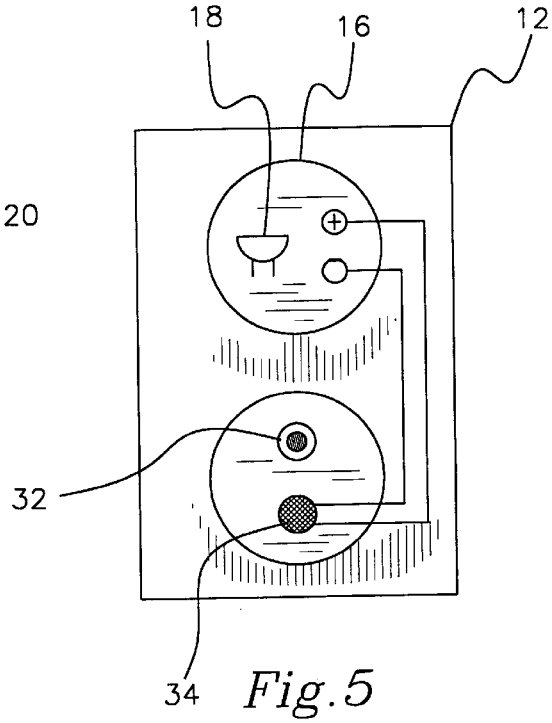
FIG. 5 is a front view of a component of the present invention that monitors a distance between at least a pair of packages.
Figure 6:
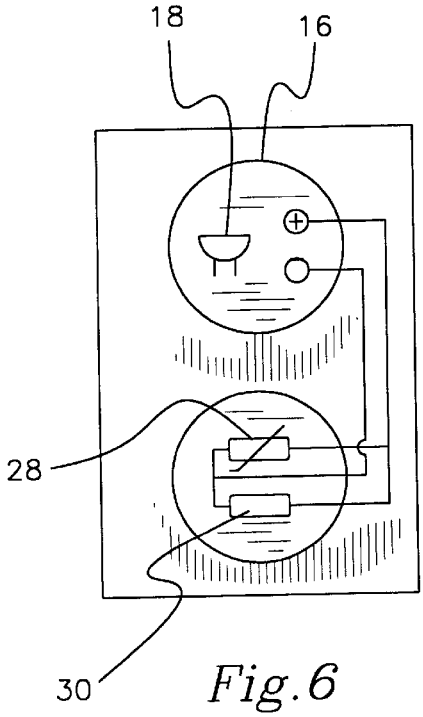
FIG. 6 is a front view of a component of the present invention that monitors both light and heat.

A first one of the mounts includes a cross-shaped housing 20 coupled to a front face of the mount. A conductive ball bearing 24 is freely situated within the housing. As shown in FIG. 3A, a pair of spaced conductors 26 pass through ends of four of five portions of the cross-shaped housing. As shown in FIG. 3B, two of the portions of the housing are angled with respect to each other such that the housing has a Y-shaped configuration when viewed from the side. Each of the conductors is connected to either the power source or alarm. As such, upon the ball bearing being situated within one of the four portions, power is supplied from the power source to the alarm, thereby indicating that the package is tilted. It should be noted that any level indicator including, but not limited to, a mercury switch or the like may be used as long as the foregoing function is accomplished.

A second one of the mounts includes a thermistor 28 and a photoelectric cell 30 each connected in parallel with respect to each other. The thermistor and photoelectric cell are further connected in series between the power source and alarm for supplying power from the power source to the alarm. This only occurs upon either the detection of light or heat. As such, an indication is given that the package is subjected to light and heat. It should be noted that in the alternative, the thermistor may be used to detect low or high temperatures and actuate the alarm accordingly.

Figure 7:
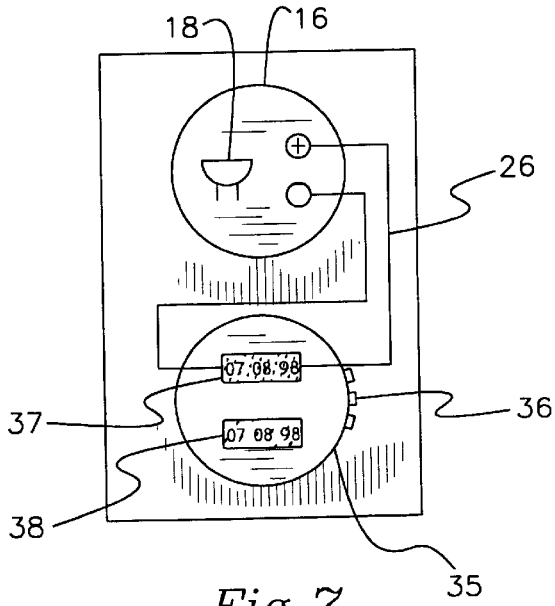
FIG. 7 is a front view of a component of the present invention that monitors the shelf life of a package.

A third and fourth of the mounts are mounted on separate packages and each include a transmitter 32 connected to the power source. In use, the transmitter is adapted for continuously transmitting a signal via free space for a predetermined distance. A receiver 34 is connected between the power source and alarm. The receiver is adapted for supplying power from the power source to the alarm upon the receipt of the signal via free space. This indicates that the pair of packages are positioned within the predetermined distance. Finally, a fifth mount includes a timepiece connected to the power source. In use, the shelf life expiration date of the package is set on a digital display screen 38, as shown in FIG. 7. The current date is displayed on a countdown display screen 37, as shown in FIG. 7. When the countdown date reaches the set shelf life expiration date, the alarm is activated. While not specifically shown, it should be readily apparent in each of the forgoing circuits, the receiver, thermistor, photoelectric cell, timepiece and tilt switch are essentially switches for connecting the power source and alarm.

It should be noted that each of the foregoing mounts may be used either separately or in any desired combination to monitor certain conditions to which a package is subjected.

The mounts may easily be situated on the associated package due to the use of the adhesive. As an option, a front cover may be situated on each mount with indicia warning against subjecting the package to the condition that is being monitored. By providing an alarm, a user may quickly take corrective action.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A condition responsive alarm system for packages comprising, in combination:

a plurality of planar rectangular mounts each constructed from a flexible material with an adhesive situated on a rear face thereof and a waxed paper backing situated over the adhesive for being removed therefrom such that the mount may be secured to a package, each of the mounts having a portable power source and an alarm for transmitting an audible signal upon the receipt of power;

a first one of said mounts including a cross-shaped housing coupled to a front face of the mount, a conductive ball bearing freely situated within the housing, and a pair of spaced conductors passing through ends of three of four portions of the cross-shaped housing and connected between the power source and alarm for supplying power from the power source to the alarm upon the ball bearing being situated within one of the three of the four portions, thereby indicating that the package is tilted;

a second one of said mounts including a thermistor and a photoelectric cell each connected in parallel with respect to each other and in series between the power source and alarm for supplying power from the power source to the alarm upon at least one of the detection of light and heat, thereby indicating that the package is subjected to light and heat;

a third and fourth of said mounts including a transmitter connected to the power source for transmitting a signal via free space for a predetermined distance and a receiver connected between the power source and alarm for supplying power from the power source to the alarm upon the receipt of the signal via free space, thereby indicating that a package is with the predetermined distance from another package; and a fifth of said mounts including a timepiece connected between the power source and the alarm for supplying power from the power source to the alarm upon reaching a previously set expiration date on the time piece.

2. A condition responsive alarm system for packages comprising:

a mount with an adhesive situated thereon;

a portable power source secured to the mount;

an indicator secured to the mount for alerting a user upon the receipt of power; and a condition responsive trigger connected between the power source and the indicator for supplying power to the indicator upon the presence of a condition;

wherein the condition responsive trigger includes a level indicator and the condition is a non-upright orientation, the level indicator including a cross-shaped housing having four portions extending from a central location of the housing, a conductive ball bearing freely movable in the housing, and a pair of spaced conductors located in ends of at least three of the four portions for supplying power from the power source to the alarm upon tilting of the housing and the ball contacting the spaced conductors in one of the four portions.

3. A condition responsive alarm system as set forth in claim 2 wherein the condition responsive trigger includes a thermistor and the condition is a predetermined amount of heat.

4. A condition responsive alarm system as set forth in claim 2 wherein the condition responsive trigger includes a photoelectric cell and the condition is a predetermined amount of light.

5. A condition responsive alarm system as set forth in claim 2 wherein the condition responsive trigger includes a radio transceiver and the condition is a predetermined proximate distance.

6. A condition responsive alarm system as set forth in claim 2 wherein the condition responsive trigger includes a timepiece and the condition is a predetermined time and date.

7. A condition responsive alarm system for packages comprising:

a plurality of mounts each constructed from a flexible material with an adhesive situated on a rear face thereof, a backing situated over the adhesive for being removable from the adhesive such that the mount may be secured to a package, each of the mounts having a portable power source and an alarm for transmitting an audible signal upon the receipt of power;

a first one of the mounts including a cross-shaped housing coupled to a front face of the mount, a conductive ball bearing freely situated in the housing, and a pair of spaced conductors extending into ends of three of four portions of the cross-shaped housing, the conductors being connected between the power source and alarm for supplying power from the power source to the alarm upon the ball bearing being situated at an end of one of the three of the four portions, thereby indicating that the package is tilted;

a second one of said mounts including a thermistor and a photoelectric cell each connected in parallel with respect to each other and in series between the power source and alarm for supplying power from the power source to the alarm upon at least one of the detection of light and heat, thereby indicating that the package has been subjected to light and heat;

a third and fourth of said mounts including a transmitter connected to the power source for transmitting a signal via free space for a predetermined distance and a receiver connected between the power source and alarm for supplying power from the power source to the alarm upon the receipt of the signal via free space, thereby indicating that a package is with the predetermined distance from another package; and a fifth of said mounts including a timepiece connected between the power source and the alarm for supplying power from the power source to the alarm upon reaching a previously set expiration time on the time piece.

8. The condition responsive alarm system of claim 2 additionally comprising a second mount with a condition responsive trigger connected between the power source and the indicator for supplying power to the indicator upon the presence of a condition and wherein the condition responsive trigger includes a thermistor and the condition is a predetermined amount of heat;

a third mount with a condition responsive trigger connected between the power source and the indicator for supplying power to the indicator upon the presence of a condition and wherein the condition responsive trigger includes a photoelectric cell and the condition is a predetermined amount of light;

fourth and fifth mounts each having a condition responsive trigger connected between the power source and the indicator for supplying power to the indicator upon the presence of a condition, and the condition responsive trigger includes a radio transceiver and the condition is a predetermined proximate distance between the fourth and fifth mounts; and a sixth mount with a condition responsive trigger connected between the power source and the indicator for supplying power to the indicator upon the presence of a condition and wherein the condition responsive trigger includes a timepiece and the condition is a predetermined time and date.

* * * * *